US012753564B2

(12) United States Patent
Kim

(10) Patent No.: US 12,753,564 B2
(45) Date of Patent: Oct. 6, 2026

(54) METHOD FOR CONSTRUCTING CONCRETE BLOCK STRUCTURE

(71) Applicant: YUJOO CO., LTD., Busan (KR)

(72) Inventor: Sangki Kim, Busar (KR)

(73) Assignee: YUJOO CO., LTD., Busan (KR)

( * ) Notice: Subject to any disclaimer, the term of this patent is extended or adjusted under 35 U.S.C. 154(b) by 246 days.

(21) Appl. No.: 18/660,902

(22) Filed: May 10, 2024

(65) Prior Publication Data

US 2024/0295094 A1 Sep. 5, 2024

Related U.S. Application Data

(63) Continuation of application No. PCT/KR2022/018052, filed on Nov. 16, 2022.

(30) Foreign Application Priority Data

Nov. 29, 2021 (KR) ..... 10-2021-0167113

(51) Int. Cl.
*E02D 23/00* (2006.01)
*E02B 3/06* (2006.01)
*E04C 3/34* (2006.01)

(52) U.S. Cl.
CPC ..... *E02D 23/00* (2013.01); *E02B 3/06* (2013.01); *E02D 2250/0023* (2013.01); *E04C 3/34* (2013.01)

(58) Field of Classification Search
CPC ... E02D 23/00; E02D 2250/0023; E04C 3/34; E02B 3/06

(Continued)

(56) References Cited

U.S. PATENT DOCUMENTS

2009/0057531 A1* 3/2009 Waite ..... E04G 21/142 52/741.11
2010/0132292 A1* 6/2010 Gullette ..... E04G 13/02 52/576
2021/0010218 A1* 1/2021 Gao ..... E02D 5/44

FOREIGN PATENT DOCUMENTS

KR 20070090733 A * 9/2007 ..... E02D 27/18
KR 10-2009-0068096 A 6/2009

(Continued)

OTHER PUBLICATIONS

International Search Report for PCT/KR2022/018052 mailed Feb. 16, 2023 from Korean Intellectual Property Office.

(Continued)

*Primary Examiner* — Brent W Herring
(74) *Attorney, Agent, or Firm* — Paratus Law Group, PLLC

(57) ABSTRACT

According to an embodiment, a first concrete block is installed in a state in which a tubular waterproof membrane and a guide pipe are temporarily coupled to the first concrete block, then a second concrete block is installed, and subsequently concrete is poured into the tubular waterproof membrane and the guide pole is removed to form a concrete column, thereby allowing the concrete column to be connected to a body of the first concrete block by means of a column rebar assembly, such that the lower end of the concrete column is formed very firmly to thus greatly improve the stiffness of the entire concrete block structure. In addition, since the concrete column is formed by means of the concrete poured into the tubular waterproofing membrane, the concrete column can be formed in the same way as that in the land environment.

3 Claims, 13 Drawing Sheets

(58) Field of Classification Search
USPC ..... 52/295, 297, 745.17
See application file for complete search history.

(56) References Cited

FOREIGN PATENT DOCUMENTS

| | | | | | |
|---|---|---|---|---|---|
| KR | 10-2011-0116262 | A | | 10/2011 | |
| KR | 10-1355805 | B1 | | 1/2014 | |
| KR | 1793984 | B1 | * | 11/2017 | |
| KR | 10-2022341 | B1 | | 9/2019 | |
| KR | 102191675 | B1 | * | 12/2020 | ..... E02D 27/525 |
| KR | 10-2292821 | B1 | | 8/2021 | |
| KR | 10-2310126 | B1 | | 10/2021 | |
| KR | 10-2310131 | B1 | | 10/2021 | |
| KR | 10-2401212 | B1 | | 5/2022 | |
| WO | WO-2019017625 | A1 | * | 1/2019 | ..... E02D 23/00 |

OTHER PUBLICATIONS

Korean Office Action for related KR Application No. 10-2021-0167113 mailed Jan. 28, 2022 from Korean Intellectual Property Office.

* cited by examiner

METHOD FOR CONSTRUCTING CONCRETE BLOCK STRUCTURE

CROSS-REFERENCE TO PRIOR APPLICATIONS

This application is a Continuation Application of PCT International Application No. PCT/KR2022/018052 (filed on Nov. 16, 2022), which claims priority to Korean Patent Application No. 10-2021-0167113 (filed on Nov. 29, 2021), which are all hereby incorporated by reference in their entirety.

BACKGROUND

The present disclosure relates to a method for constructing a concrete block structure installed on land or at sea to form various structures and, more particularly, to a method for constructing a concrete block structure which is installed underwater or on the surface of the water for various purposes, such as a concrete structure installed underwater such as a berthing facility for a harbor, a wave-dissipating structure installed on the coast, and a breakwater, or a concrete structure floating on the surface of the water such as a platform for wind power generation.

An underwater concrete structure is installed for various purposes, such as a berthing facility for a harbor, a wave-dissipating structure installed on the coast, and a breakwater.

Meanwhile, a widely known construction technique for the construction of underwater structures is a large caisson method. The large caisson method has the advantage of being able to withstand big waves, but it requires high costs for transportation and construction and has various constraints, since a large caisson which is very huge structure is required to be fabricated on land, transported to an installation point, and then installed underwater.

In order to solve the problems of this large caisson method, the present inventor proposed a method of forming an underwater concrete block structure by stacking small concrete blocks in multiple layers according to the depth of water.

The present inventor's Korean Patent No. 10-1355805 (registered on Jan. 15, 2014) entitled "Underwater Concrete Block Structure and Construction Method thereof" discloses a technique in which a concrete column is formed in a waterproof membrane and an upper concrete block and a lower concrete block are coupled together in a structural integrity by concrete columns, thereby having sufficient structural stability even in the waves caused by large typhoons.

In the prior art, the upper concrete block and the lower concrete block are structurally integrated with each other by the concrete column, but the reinforcing bars of the concrete column and the reinforcing bars of the concrete block located below are not connected to each other.

In such a structure, when a concrete block structure receives strong force from a side, the lower part of the concrete column may be a weak point.

The present disclosure is proposed to further improve the prior art.

Meanwhile, offshore concrete structures are fabricated and used for various purposes.

Offshore concrete structures may be concrete structures that float on a water surface, such as wind power generation platforms, or concrete structures that sink in the water for such purposes as those of breakwaters or anchors.

In general, a large concrete structure is generally fabricated with a caisson structure.

When such a large concrete structure is fabricated on land, it is very difficult to move the concrete structure fabricated on land to the sea due to weight of the concrete structure.

As a technology to solve this problem, a method of fabricating a floatable large concrete structure on a large barge has recently been used. In this case, not only is there the inconvenience of fabricating a concrete structure on a large barge, but there is also the problem of having to use an expensive large barge for a very long period of time.

Meanwhile, Korean Patent No. 10-2310126 entitled "METHOD OF CONSTRUCTING UNDERWATER CONCRETE BLOCK STRUCTURE" (registered on Sep. 30, 2021), Korean Patent No. 10-2310131 entitled "FLOATABLE CONCRETE BLOCK STRUCTURE AND FABRICATING METHOD THEREFOR" (registered on Sep. 30, 2021), and Korean Patent No. 10-2292821 entitled "FLOATABLE CONCRETE BLOCK STRUCTURE AND FABRICATING METHOD THEREFOR" (registered on Aug. 18, 2021) as prior arts of the present inventor have been proposed, and these prior arts discloses a technique in which after a first concrete block in which a column rebar assembly is formed is installed, a second concrete block in which a through hole is formed is installed on the upper side of the first concrete block, and concrete is poured into a concrete-column continuous hole formed by the through hole into which the column rebar assembly is inserted so as to form a concrete column in which the column rebar assembly and the poured concrete are integrated with each other.

These prior arts have the risk that seawater mixes with concrete when pouring the concrete to form a concrete column.

SUMMARY

The present disclosure has been made to solve the above problems occurring in the prior art, and is intended to propose a method for constructing a concrete block structure, in which a concrete column is formed by concrete poured into a tubular waterproof membrane so that the concrete column can be formed in the same way as the land environment, thereby allowing the concrete column to be firmly formed.

In order to accomplish the above objectives, the present disclosure provides a method for constructing a concrete block structure, the method including: a first concrete block assembly installation step of installing a first concrete block assembly in which a first concrete block comprising a first concrete block body and a column rebar assembly extending vertically upward from a lower part thereof connected to an inside of the first concrete block body and protruding upward from the first concrete block body, a guide pole comprising a guide pipe extending vertically, and a tubular waterproof membrane which has a shape of a tube with open upper and lower parts and extends vertically along an inside of the guide pipe and has a lower end arranged by being bent to an outside of the guide pipe are temporarily assembled with each other, wherein the column rebar assembly extends vertically upward along an inside of the tubular waterproof membrane, and the guide pipe is temporarily fixed on an upper surface of the first concrete block body; a second concrete block installation step of installing a second concrete block comprising a second concrete block body having a through hole extending vertically such that a concrete block assembly is formed by installing the second concrete block on the first concrete block so that the guide pole is inserted into the through hole of the second concrete block after the first concrete block assembly installation step, wherein the concrete block assembly has a concrete-column continuous hole comprising the through hole and having a closed lower end; and a concrete column formation step of forming a concrete column by pouring concrete into the tubular waterproof membrane and removing the guide pole to form the concrete column in which the column rebar assembly and the poured concrete are integrated with each other while extending vertically along the inside of the tubular waterproof membrane in the concrete-column continuous hole after the second concrete block installation step, wherein the first concrete block and the second concrete block are coupled to each other by the concrete column to form a concrete block structure.

In the above, a watertight packing is preferably provided on a lower end of the guide pipe so that water is prevented from being introduced into the guide pole from the outside.

In the above, it is preferable that the column rebar assembly has a length to pass through the concrete-column continuous hole and protrude upward from the concrete-column continuous hole, and a cap concrete formation step of forming a cap concrete on the concrete block assembly after the concrete column formation step so that an upper part of the column rebar assembly is connected to an inside of the cap concrete is comprised.

As described above, according to the present disclosure, a concrete column is formed by concrete poured into a tubular waterproof membrane so that the concrete column can be formed in the same way as the land environment, thereby allowing the concrete column to be firmly formed.

DETAILED DESCRIPTION

Figure 1:
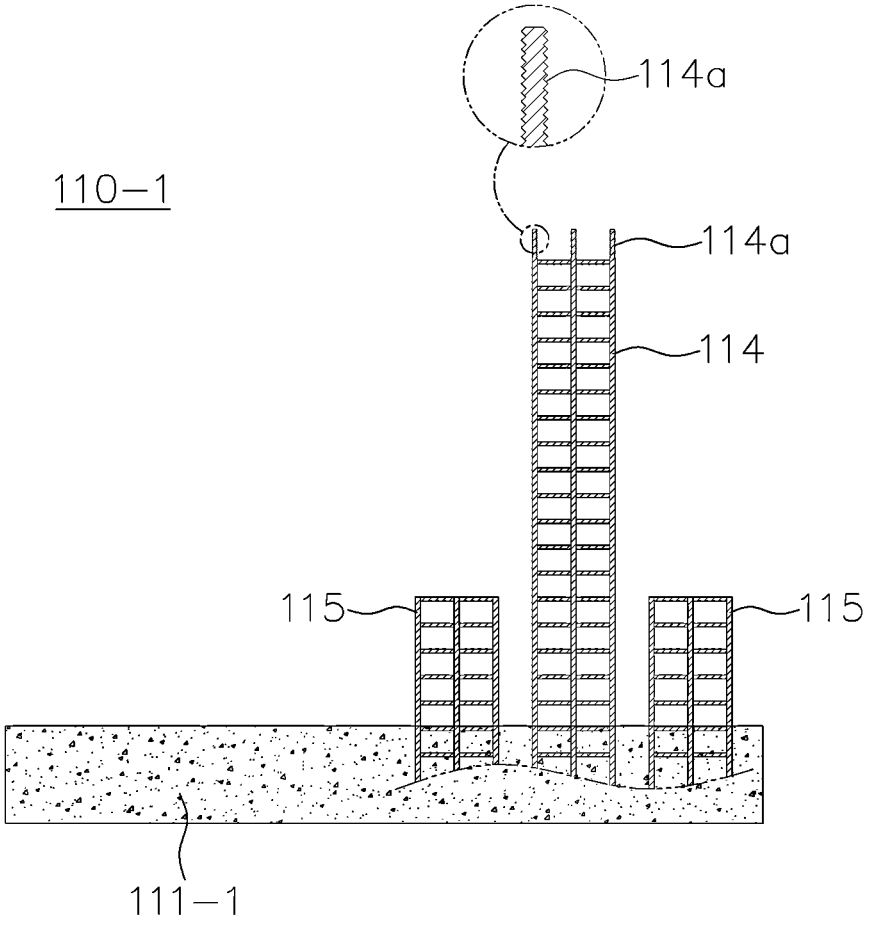
FIGS. 1 to 8 are views sequentially illustrating a method for constructing a concrete block structure according to an embodiment of the present disclosure.

Below, with reference to the attached drawings, embodiments of the present disclosure will be described in detail so that those skilled in the art can easily implement the embodiments. However, the present disclosure may be implemented in several different forms and is not limited to the embodiments described herein. In order to clearly explain the present disclosure in the drawings, parts unrelated to the description were omitted, and similar drawing numbers were assigned to similar parts throughout the specification.

Throughout the specification, when a part is said to "include" a certain element, this means that it may further include other elements rather than excluding other elements, unless specifically stated to the contrary.

Figure 2:
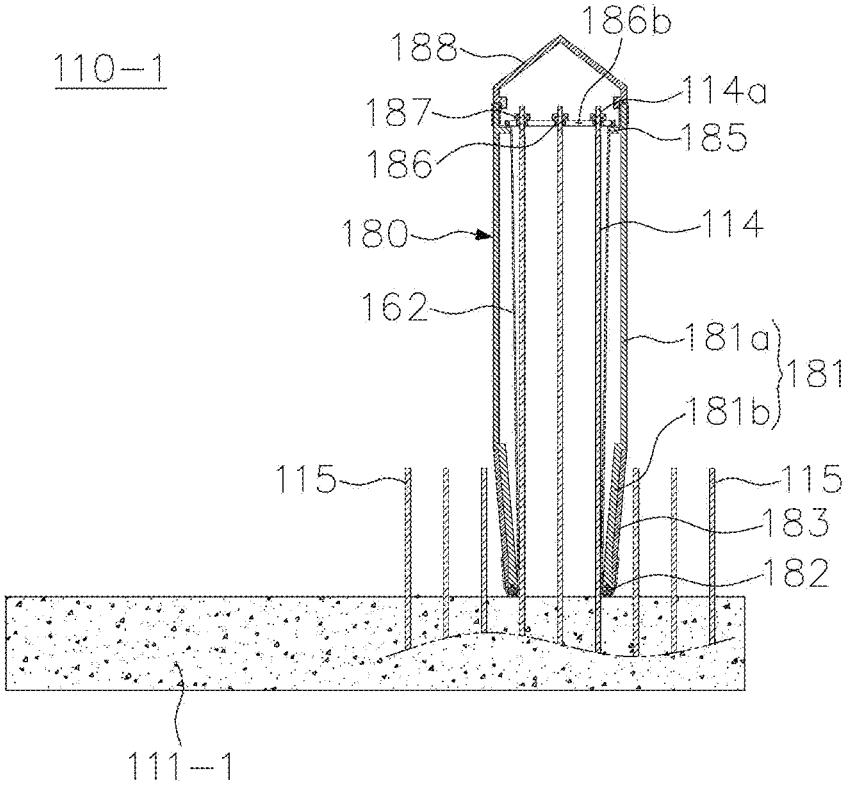
Figure 3:
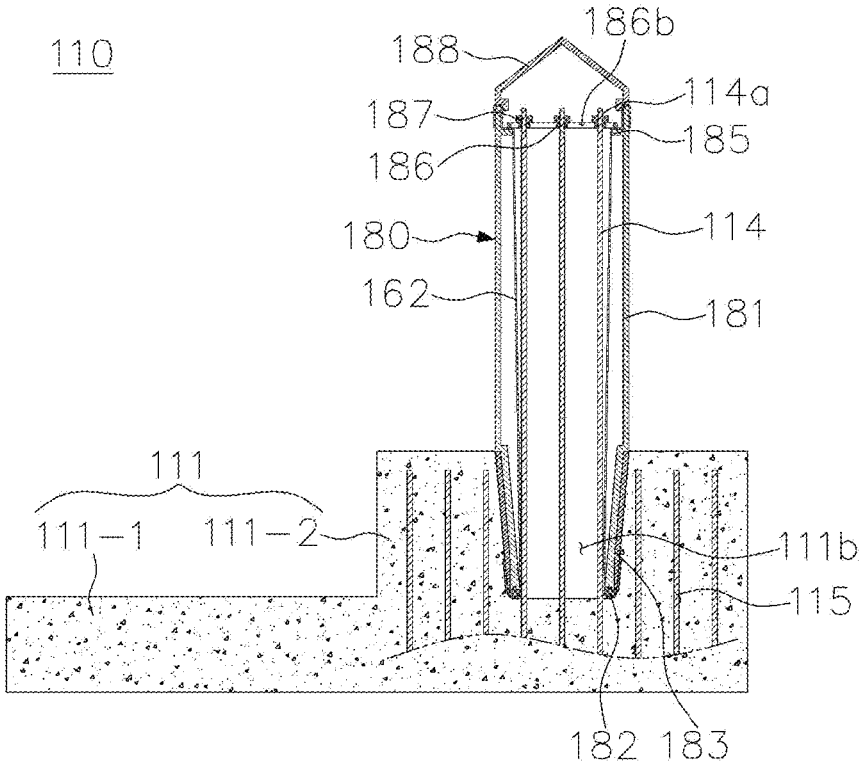
Figure 4:
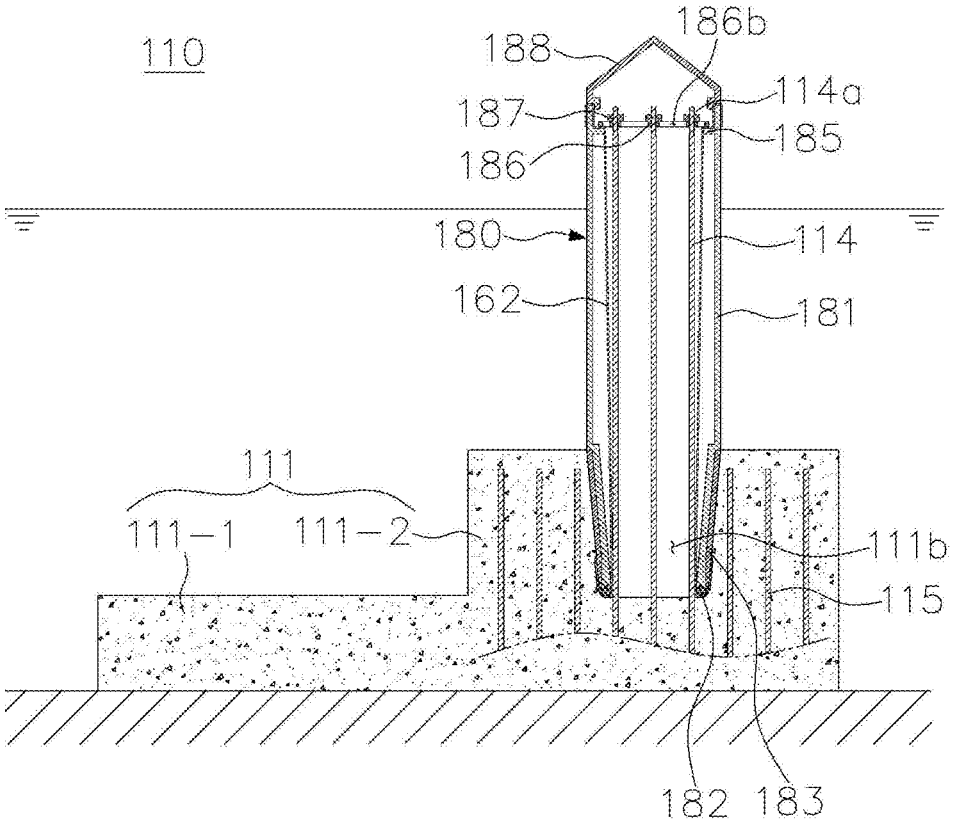
Figure 5:
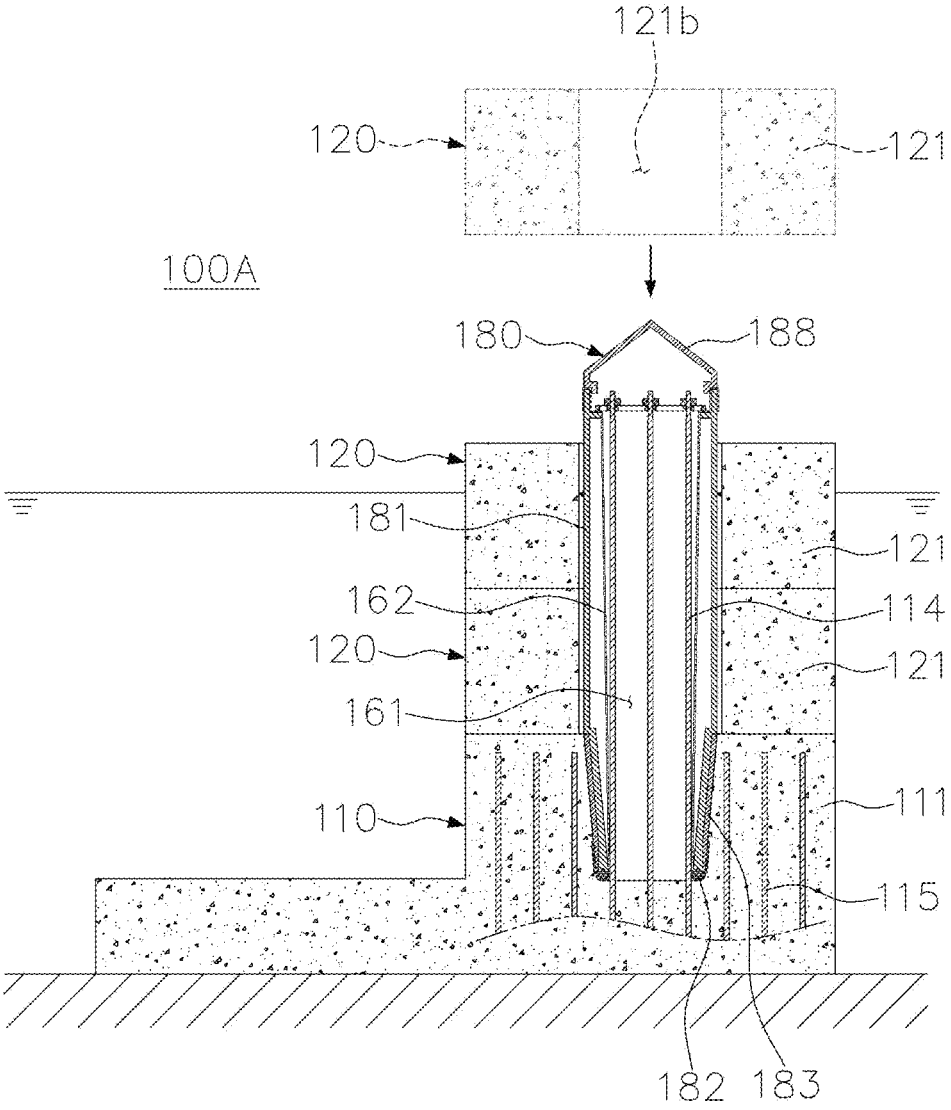
Figure 7:
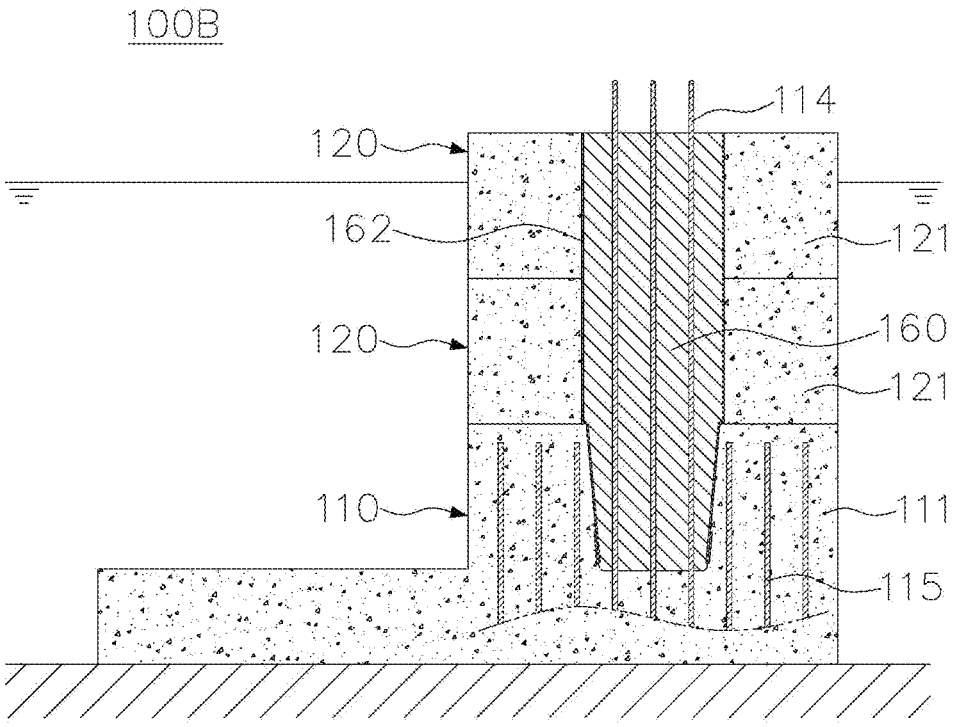
Figure 8:
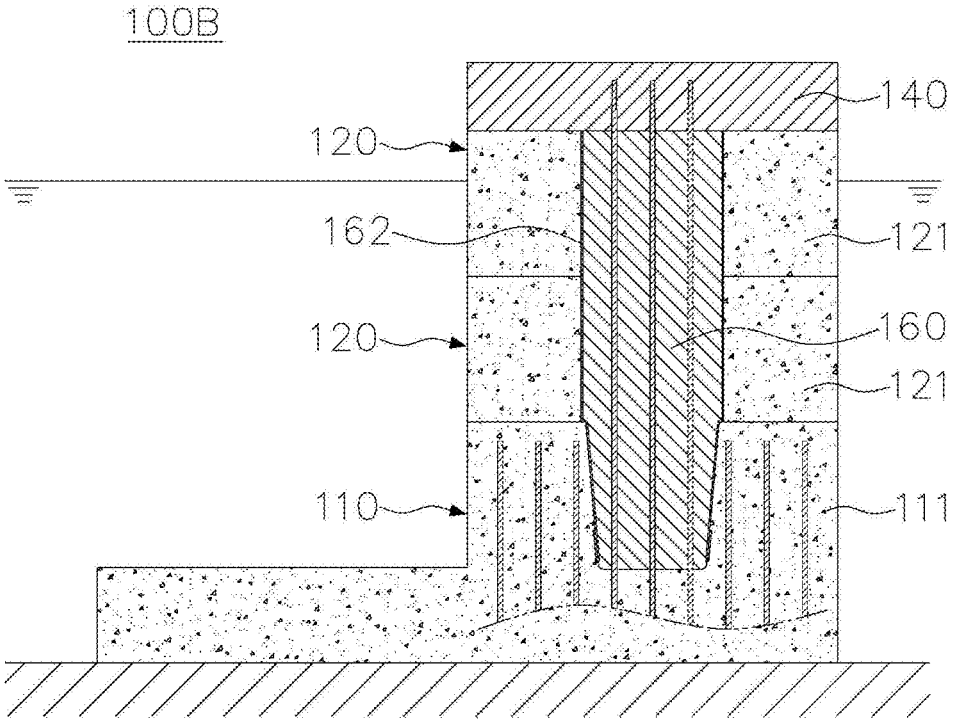
Figure 9:
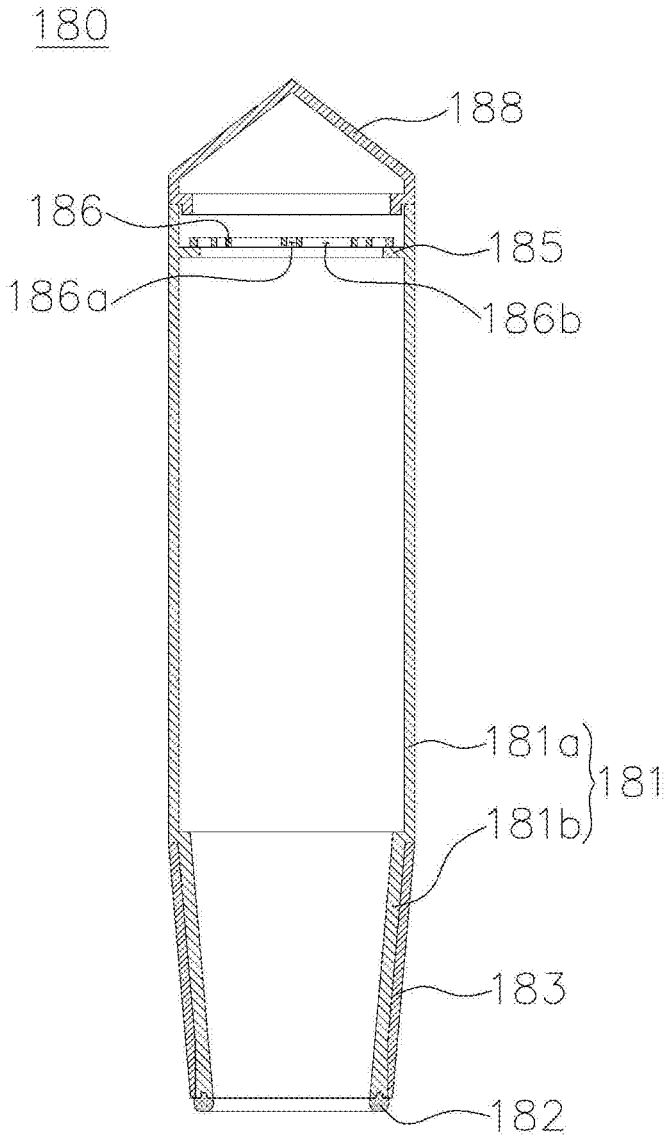
FIG. 9 is a sectional view of a guide pole of FIG. 2.
Figure 10:
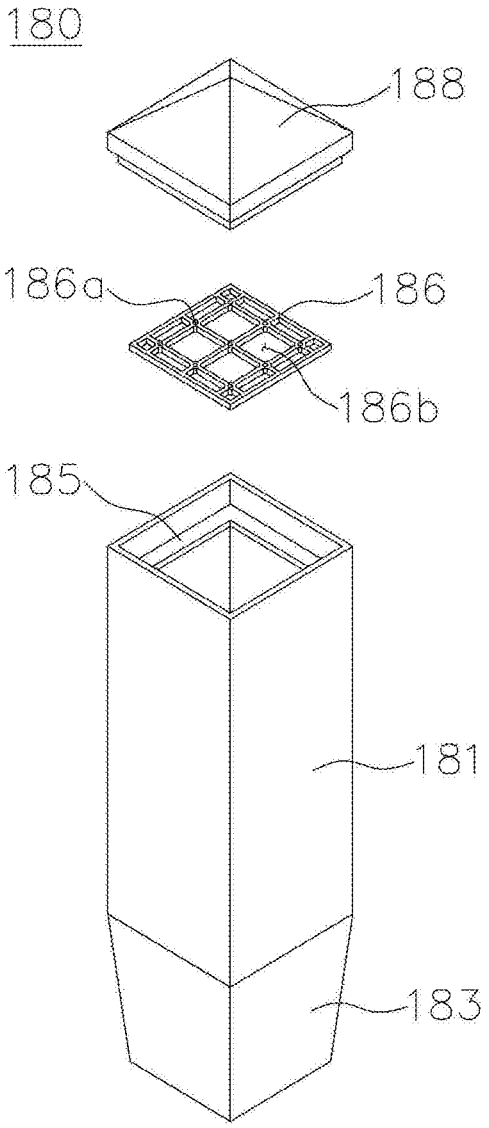
FIG. 10 is an exploded perspective view of the guide pole of FIG. 9.
Figure 11:
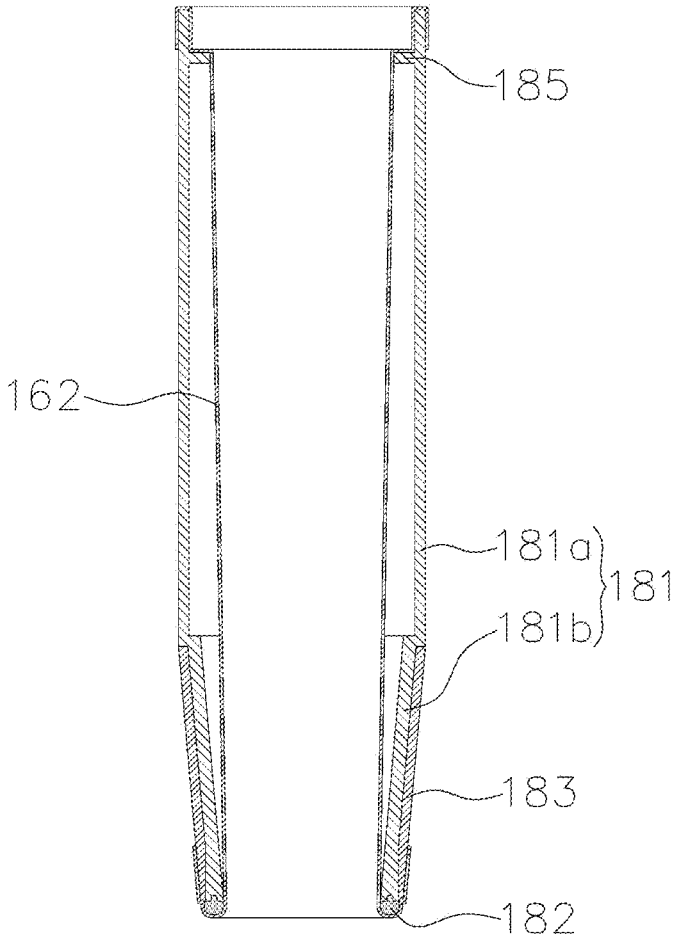
FIG. 11 is a sectional view of a state in which a tubular waterproof membrane is coupled to a guide pipe of FIG. 2.
Figure 12:
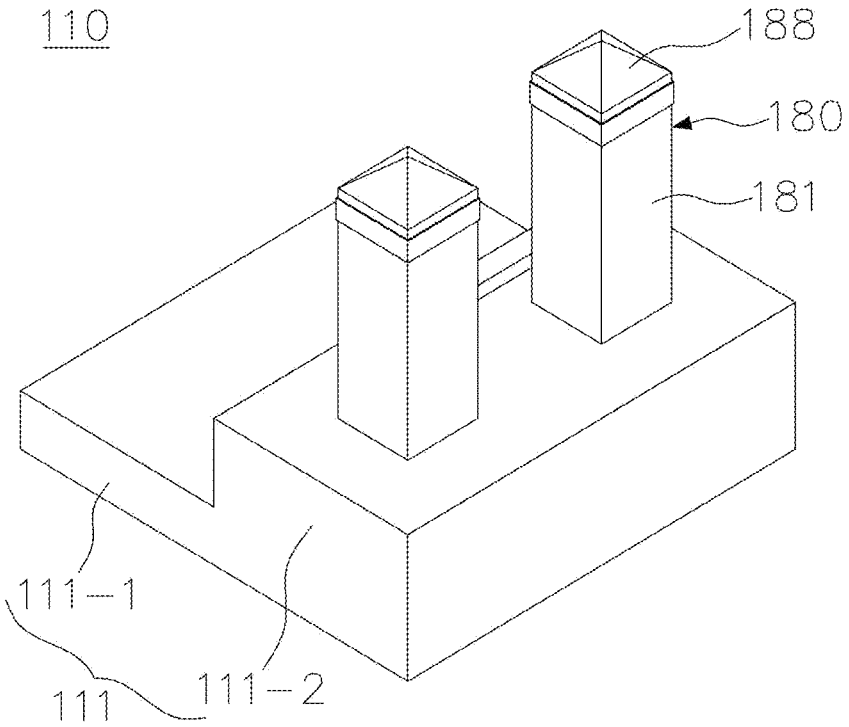
FIG. 12 is a perspective view of a first concrete block assembly of FIG. 3.
Figure 13:
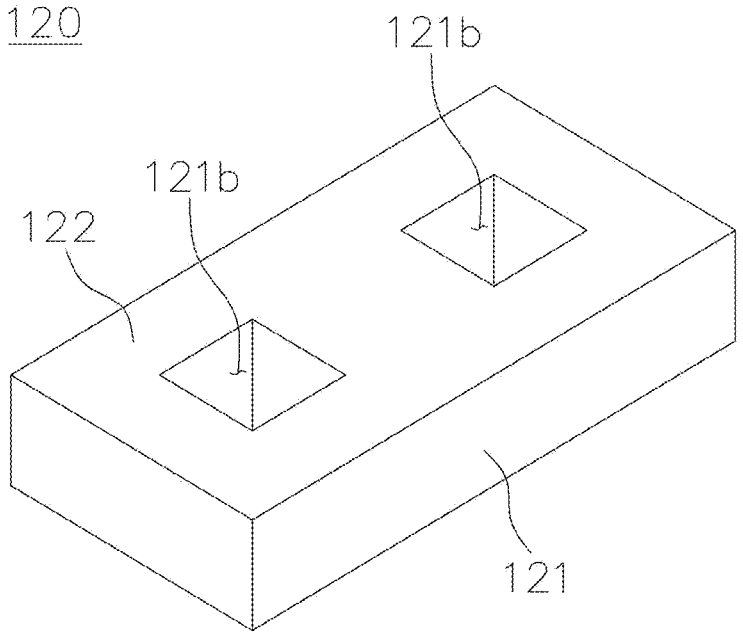
FIG. 13 is a perspective view of a second concrete block of FIG. 5.

FIGS. 1 to 8 are views sequentially illustrating a method for constructing a concrete block structure according to an embodiment of the present disclosure, FIG. 9 is a sectional view of a guide pole of FIG. 2, FIG. 10 is an exploded perspective view of the guide pole of FIG. 9, FIG. 11 is a sectional view of a state in which a tubular waterproof membrane is coupled to a guide pipe of FIG. 2, FIG. 12 is a perspective view of a first concrete block assembly of FIG. 3, and FIG. 13 is a perspective view of a second concrete block of FIG. 5.

(1) A Concrete Block for a Bottom Fabrication Step

As illustrated in FIG. 1, the concrete block 110-1 for a bottom is fabricated.

The concrete block 110-1 for a bottom includes a concrete block body 111-1 for a bottom, a column rebar assembly 114, and supplementary rebar assemblies 115.

In this embodiment, the concrete block body 111-1 for a bottom is a rectangular concrete block with a relatively thin thickness.

In the concrete block body 111-1 for a bottom, the column rebar assembly 114 and the supplementary rebar assemblies 115 are provided to protrude upward from the concrete block body 111-1.

In this embodiment, the column rebar assembly 114 and the supplementary rebar assemblies 115 are located on one side of the concrete block body 111-1 for a bottom in the directions of left and right.

In this embodiment, two separate column rebar assemblies 114 are provided, and supplementary rebar assemblies 115 are arranged to surround these column rebar assemblies 114 (see FIG. 12).

The column rebar assembly 114 has a lower part connected to the inside of the concrete block body 111-1 for a bottom (specifically, the internal reinforcing bars of the concrete block body 111-1 for a bottom), and extends vertically upward from the lower part to protrude upward from the concrete block body 111-1 for a bottom.

In the column rebar assembly 114, vertical reinforcing bars extending in vertical directions and horizontal reinforcing bars extending in horizontal directions are coupled to each other.

Meanwhile, the upper end part of each of the vertical reinforcing bars of the column rebar assembly 114 is threaded to have a male threaded portion 114*a*.

The supplementary rebar assembly 115 has a lower part connected to the inside of the concrete block body 111-1 for a bottom (specifically, the internal reinforcing bars of the concrete block body 111-1 for a bottom), and extends vertically upward from the lower part to protrude upward from the concrete block body 111-1 for a bottom.

In the supplementary rebar assembly 115, vertical reinforcing bars extending in vertical directions and horizontal reinforcing bars extending in horizontal directions are coupled to each other.

Meanwhile, the protruding height of the supplementary rebar assembly 115 is lower than the protruding height of the column rebar assembly 114.

In addition, the supplementary rebar assemblies 115 are arranged to surround the column rebar assembly 114.

In the drawings below, for the ease of understanding of the drawings, only vertical reinforcing bars are illustrated and horizontal reinforcing bars are omitted in the column rebar assembly 114 and the supplementary rebar assembly 115.

With this structure, a gap between the supplementary rebar assembly 115 and the column rebar assembly 114 can be minimized. That is, the gap between the supplementary rebar assembly 115 and the column rebar assembly 114 is sufficient to be a gap into which the guide pole 180 to be described later can be inserted.

Meanwhile, each of the supplementary rebar assembly 115 and the column rebar assembly 114 may have only a portion of a lower part prefabricated and be installed in advance in the concrete block body 111-1 for a bottom when the concrete block body 111-1 for a bottom is fabricated, and after fabricating the concrete block body 111-1 for a bottom, the upper part of each of the supplementary rebar assembly 115 and the column rebar assembly 114 may be fabricated and assembled with the lower part installed in advance.

(2) A Guide Pole Installation Step

After the concrete block for a bottom fabrication step, as illustrated in FIG. 2, the guide pole 180 to which the tubular waterproof membrane 162 is coupled is installed on the upper part of the concrete block body 111-1 for a bottom.

In FIG. 2, the guide pole 180 includes a guide pipe 181, a watertight packing 182, a separation auxiliary cover 183, a protruding support 185, a rebar fixer 186, a fixing nut 187, and an upper-side insertion guide part 188.

FIG. 9 illustrates sectional conceptual diagram of the guide pole 180, and FIG. 10 illustrates the exploded perspective view of the guide pole 180.

FIGS. 9 and 10 illustrate the guide pole 180 to which the tubular waterproof membrane 162 is not coupled.

The guide pipe 181 extends in the vertical direction. In this embodiment, the guide pipe 181 has the shape of a quadrangular pipe but may be variously modified.

The guide pipe 181 is divided into an upper pipe 181*a* and a lower pipe 181*b*, wherein the upper pipe 181*a* extends vertically from the upper end of the lower pipe, and the lower pipe 181*b* extends downward to incline inward from the lower end of the upper pipe 181*a*.

That is, the lower pipe 181*b* has a cross-sectional area decreasing gradually toward the lower side.

In addition, the separation auxiliary cover 183 is provided on the outer surface of the lower pipe 181*b* to cover the outer surface of the lower pipe 181*b*.

The separation auxiliary cover 183 prevents the direct contact of the lower pipe 181*b* made of metal with a concrete wall 111-2 for reinforcement to be described later so that the guide pole 180 is easily separated from the concrete wall 111-2 for reinforcement.

As the separation auxiliary cover 183, an elastic rubber plate, a Styrofoam plate, or a foam rubber plate, etc. may be used.

Meanwhile, the lower end of the upper pipe 181*a* (that is, the upper end of the lower pipe 181*b*) is located higher than the upper end of the supplementary rebar assembly 115. This is intended to ensure that the separation auxiliary cover 183 has a higher height than the height of the concrete wall 111-2 for reinforcement, which will be described later.

The watertight packing 182 is provided on the lower end of the guide pipe 181, specifically, on the lower end of the lower pipe 181*b*.

The watertight packing 182 is intended to prevent water from being introduced into the guide pole 180 from the outside when the guide pole 180 is installed.

The protruding support 185 is provided inside the upper end part of the guide pipe 181, wherein the rebar fixer 186 is arranged horizontally on the upper part of the protruding support 185.

The rebar fixer 186 is seated on the upper surface of the protruding support 185, and further, may be separated from the protruding support 185.

The rebar fixer 186 has a plurality of rebar penetration holes 186*a* and a plurality of openings 186*b* for concrete pouring.

Meanwhile, the tubular waterproof membrane 162 is installed on the guide pole 180.

Accordingly, when installing the guide pipe 181, the tubular waterproof membrane 162 is installed together with the guide pipe 181.

The tubular waterproof membrane 162, which has the shape of a tube having open upper and lower parts, extends up and down along the inside of the guide pipe 181, and the lower end part of the tubular waterproof membrane 162 is arranged by being bent to the outside of the guide pipe 181. That is, since the upper part of the tubular waterproof membrane 162 is open, concrete can be poured thereinto. In addition, since the lower part of the tubular waterproof membrane 162 is open, the column rebar assembly can be inserted thereinto.

The guide pole 180 is an element that will be removed later, but the tubular waterproof membrane 162 is left in the concrete block structure and contributes to forming a concrete column 160.

That is, the tubular waterproof membrane 162 can be separated from the guide pole 180.

A method of installing such a guide pole 180 will be described.

The tubular waterproof membrane 162 is installed inside the guide pipe 181.

FIG. 11 is a sectional view of a state in which the tubular waterproof membrane 162 is coupled to the guide pipe 181.

The column rebar assembly 114 is inserted into the tubular waterproof membrane 162 installed inside the guide pipe 181, and the tubular waterproof membrane 162 and the guide pipe 181 are installed on the upper part of the concrete block body 111-1 for a bottom such that the supplementary rebar assembly 115 is arranged outside the guide pipe 181.

The tubular waterproof membrane 162 and the guide pipe 181 are installed, the vertical reinforcing bars of the column rebar assembly 114 passes through the rebar penetration holes 186*a* of the rebar fixer 186, the edge of the rebar fixer 186 is supported on the protruding support 185, and then the fixing nut 187 is engaged with the male threaded portion 114*a* of the column rebar assembly 114. In this case, while the fixing nut 187 presses the rebar fixer 186, the column rebar assembly 114 is temporarily coupled to the rebar fixer 186, and the guide pipe 181 is temporarily fixed to the concrete block body 111-1 for a bottom.

When the guide pipe 181 is temporarily fixed, the watertight packing 182 is compressed and prevents water from being introduced into the guide pole 180.

Next, the upper-side insertion guide part 188 is installed on the upper end of the guide pipe 181.

The upper-side insertion guide part 188 is located on the upper end of the guide pipe 181 and has an upwardly tapered shape.

The upper-side insertion guide part 188 is coupled detachably to the guide pipe 181 and has a guide protrusion formed on the lower end of the upper-side insertion guide part 188 so that the guide protrusion is inserted into the upper end part of the guide pipe 181.

The upper-side insertion guide part 188 is intended to guide the installation of a second concrete block 120, which will be described later.

(3) A Concrete Wall for Reinforcement Formation Step

After the guide pole installation step, as illustrated in FIGS. 3 and 12, the concrete wall 111-2 for reinforcement is formed.

The concrete wall 111-2 for reinforcement is formed such that the supplementary rebar assembly 115 protruding upward from the concrete block body 111-1 for a bottom is embedded in the concrete wall 111-2 for reinforcement, and a portion in which the column rebar assembly 114 is located is formed as a column coupling groove 111*b* which is an empty space.

Due to the guide pole 180, concrete does not flow into the portion in which the column rebar assembly 114 is located, and thus the concrete wall 111-2 for reinforcement has the column coupling groove 111*b* through which the column rebar assembly 114 passes and with which the guide pole 180 (specifically, the separation auxiliary cover 183) is in contact.

Such a concrete wall 111-2 for reinforcement covers a portion of the upper surface of the concrete block body 111-1 for a bottom and is integrated with the concrete block body 111-1 for a bottom by the supplementary rebar assembly 115, and thus the concrete block body 111-1 for a bottom and the concrete wall 111-2 for reinforcement constitute a first concrete block body 111.

A concrete block including the first concrete block body 111 and the column rebar assembly 114 is referred to as the first concrete block 110.

The shape of the first concrete block 110 in this embodiment is only an example, and various modifications thereof are possible.

(4) A First Concrete Block Assembly Installation Step

After the concrete wall for reinforcement formation step, as illustrated in FIG. 4, the first concrete block 110 on which the guide pole 180 is installed, that is, the first concrete block assembly is installed.

In this embodiment, the first concrete block assembly is installed underwater. Accordingly, the first concrete block 110 is installed on an underwater ground.

(5) A Second Concrete Block Installation Step

After the first concrete block assembly installation step, as illustrated in FIG. 5, the second concrete block 120 is installed on the first concrete block 110 to form a concrete block assembly 100A.

First, the structure of the second concrete block 120 will be described with reference to FIG. 13.

The second concrete block 120 includes a second concrete block body 121, wherein the second concrete block body 121, which has a rectangular parallelepiped shape, has two through holes 121*b* extending in vertical directions.

The cross-sectional shape of each of the through holes 121*b* is the shape of a quadrangular cross section corresponding to the cross-sectional shape of the guide pipe 181, and the cross-sectional area of the through hole 121*b* is larger than the cross-sectional area of the upper pipe 181*a*.

Next, the process of installing the second concrete block 120 will be described.

As illustrated in FIG. 5, the second concrete block 120 is installed so that the column rebar assembly 114 of the first concrete block 110 installed underwater is inserted into the through holes 121*b* of the second concrete block 120.

More specifically, the second concrete block 120 is lowered from the upper side of the guide pole 180 to the lower side thereof so that the guide pole 180 installed in the first concrete block 110 is inserted into the through hole 121*b* of the second concrete block 120.

In this case, the upper-side insertion guide part 188 of the guide pole 180 guides the seating position of the second concrete block 120 while being easily inserted into the through hole 121*b* of the second concrete block 120.

A plurality of second concrete blocks 120 may be installed in multiple layers on the first concrete block 110 as illustrated in FIG. 5, or in another embodiment, a second concrete block 120 may be installed in one layer on the first concrete block 110.

A concrete-column continuous hole 161 having a closed lower end is formed in the concrete block assembly 100A formed according to the installation of the second concrete block 120.

The concrete-column continuous hole 161 includes the through hole 121*b* of the second concrete block 120. In this embodiment, the concrete-column continuous hole 161 is formed by the through hole 121*b* of the second concrete block 120 and the column coupling groove 111*b* of the first concrete block 110.

In the concrete block assembly 100A, water is present in the concrete-column continuous hole 161, but water is not present in the guide pole 180 due to the tubular waterproof membrane 162 and the watertight packing 182, and thus water is present only in space outside the guide pole 180.

Figure 14:
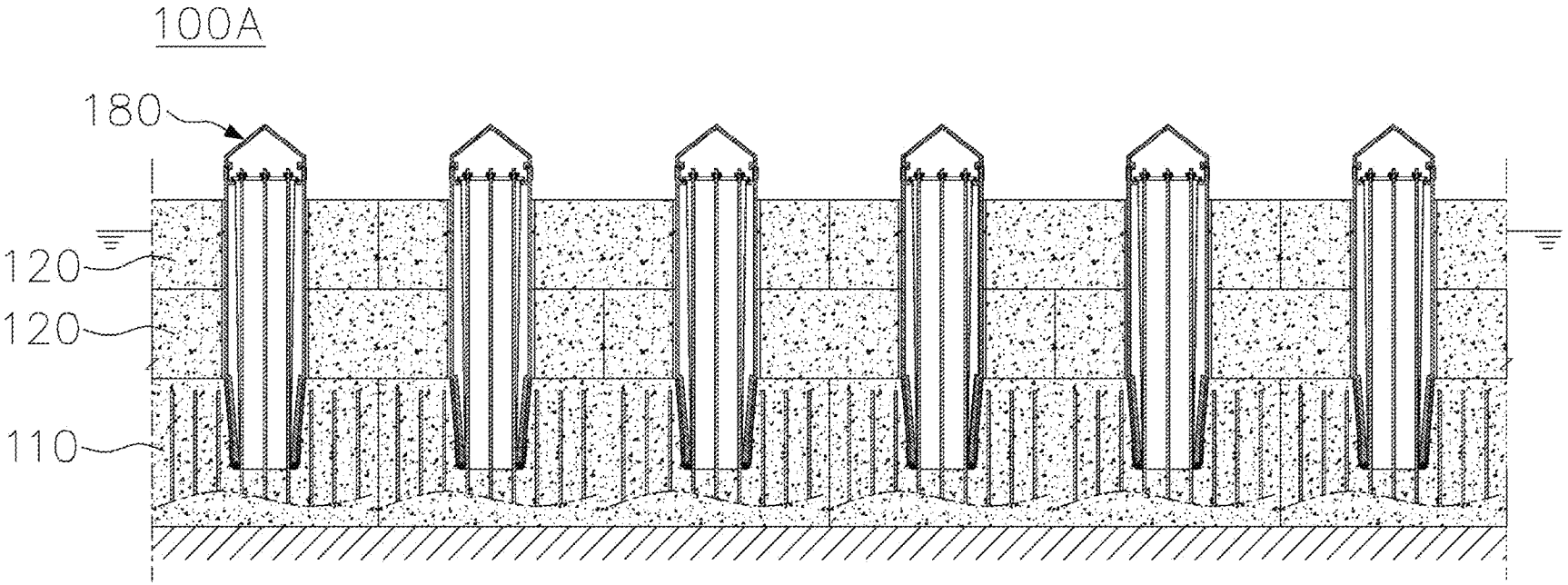
FIG. 14 is a sectional view illustrating a state in which concrete block assemblies of FIG. 5 are continuously disposed horizontally.

As illustrated in FIG. 14, in the concrete block assembly 100A, a plurality of first concrete blocks 110 is successively arranged in a horizontal direction, and further, a plurality of second concrete blocks 120 is successively arranged in the horizontal direction.

(6) A Concrete Column Formation Step

Figure 6:
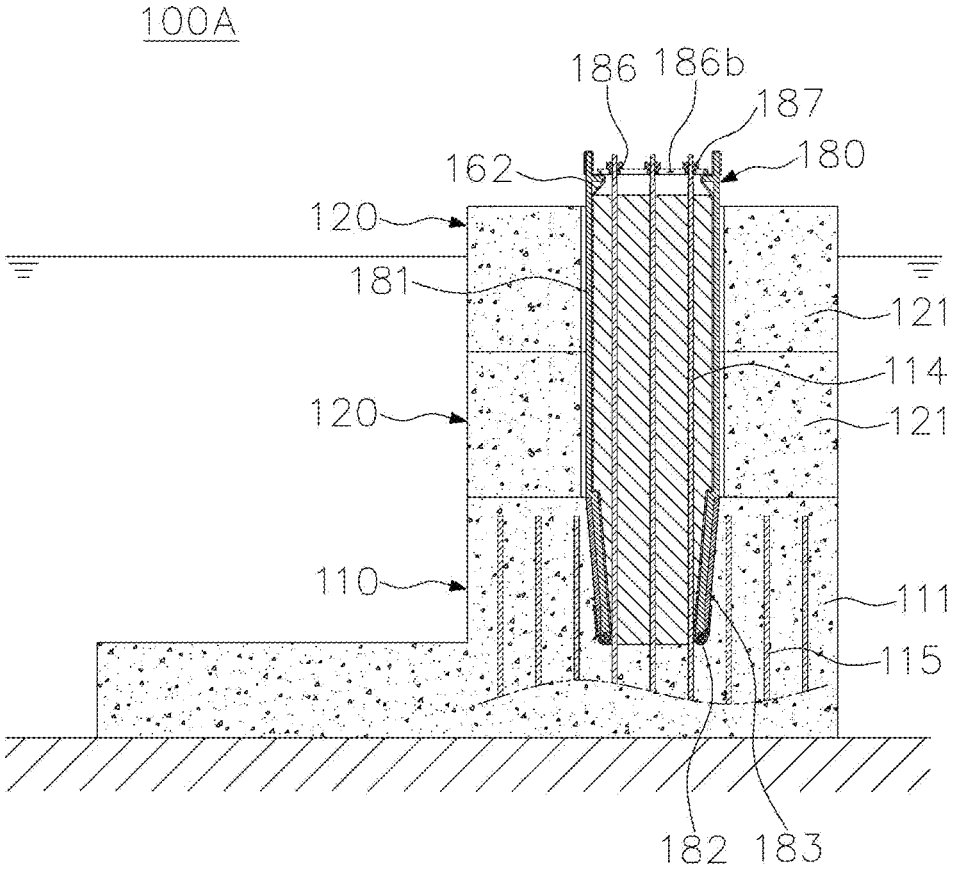

After the second concrete block installation step, as illustrated in FIGS. 6 and 7, concrete is poured into the tubular waterproof membrane 162 located in the concrete-column continuous hole 161 and the guide pole 180 is removed to form the concrete column 160 in which the column rebar assembly 114 and the poured concrete are integrated with each other while extending vertically along the inside of the tubular waterproof membrane 162 in the concrete-column continuous hole 161.

The first concrete block 110 and the second concrete block 120 are coupled to each other by the concrete column 160 to primarily form the concrete block structure 100B.

Specific work sequence will be described.

First, the upper-side insertion guide part 188 is removed from the guide pole 180.

Next, concrete is poured into the tubular waterproof membrane 162 through the openings 186*b* for concrete pouring of the rebar fixer 186 (see FIG. 6).

After the concrete pouring, the fixing nut 187 is disengaged to remove the rebar fixer 186 upward, and after removing the rebar fixer 186, the guide pipe 181 is removed upward. In this case, the tubular waterproof membrane 162 is left in the concrete-column continuous hole 161 (see FIG. 7).

When removing the guide pipe 181, the lower part of the guide pipe 181 can be easily separated from the concrete wall 111-2 for reinforcement due to the separation auxiliary cover 183.

Meanwhile, when the guide pipe 181 is removed, the tubular waterproof membrane 162 is brought into close contact with the first concrete block 110 and the second concrete block 120 by the pressure of poured concrete, and accordingly, water (water present outside the tubular waterproof membrane 162) inside the concrete-column continuous hole 161 is pushed out.

Accordingly, the concrete column 160 is formed by the integration of the column rebar assembly 114 with the poured concrete along the inside of the tubular waterproof membrane 162 in the concrete-column continuous hole 161.

Meanwhile, since there is no water inside the tubular waterproof membrane 162 immediately before pouring concrete, the pouring of concrete for forming the concrete column 160 can be performed in the same environment as the land environment.

That is, since the concrete column 160 is formed inside the tubular waterproof membrane 162, there is no need to worry about mixing with external seawater.

After the concrete column 160 is formed, the upper end part of the tubular waterproof membrane 162 exposed to the outside is removed.

According to an embodiment, after removing the guide pole 180, a concrete block fixer (not shown) can be installed on the male threaded portion 114*a* of the column rebar assembly 114 to fix the second concrete block 120 located at the uppermost part. In this way, when the concrete block assembly 100A is fixed by using the concrete block fixer (not shown), the structural stability of the concrete block assembly 100A can be increased until the concrete column 160, which will be described later, is completely formed.

Meanwhile, the upper end part of the column rebar assembly 114 does not form the concrete column 160 and protrudes upward from the concrete column 160.

That is, the column rebar assembly 114 of the first concrete block 110 has a length to pass through the concrete-column continuous hole 161 and protrude upward from the concrete-column continuous hole 161.

(7) A Cap Concrete Formation Step

After the concrete column formation step, as illustrated in FIG. 8, the cap concrete 140 is formed on the concrete block assembly 100A to complete an underwater concrete block structure 100B.

In this case, the upper part of the column rebar assembly 114 protruding upward from the concrete-column continuous hole 161 is connected to the internal rebar of the cap concrete 140.

In the concrete block structure 100B constructed through this construction method, the concrete column 160 is connected to the first concrete block body 111 by the column rebar assembly 114.

In addition, the lower part of the concrete column 160 is supported by the concrete wall 111-2 for reinforcement of the first concrete block body 111.

In addition, when forming the concrete wall 111-2 for reinforcement, the guide pole 180 is used, so a gap between the supplementary rebar assembly 115 and the column rebar assembly 114 can be minimized.

In addition, since the concrete column 160 is formed inside the tubular waterproof membrane 162, there is no concern about external seawater mixing with the concrete column 160.

Therefore, the lower part of the concrete column 160, which may be the most vulnerable part of the concrete block structure 100B, is formed very firmly, thereby significantly improving the rigidity of the entirety of the concrete block structure.

Such a structure of the present disclosure may be variously applied to "FLOATABLE CONCRETE BLOCK STRUCTURE AND FABRICATING METHOD THEREFOR" (registered on Sep. 30, 2021) in Korean Patent No. 10-2310131 and "FLOATABLE CONCRETE BLOCK STRUCTURE AND FABRICATING METHOD THEREFOR" (registered on Aug. 18, 2021) in Korean Patent No. 10-2292821, etc.

The description of the present disclosure described above is for illustrative purposes, and it can be understood that anyone with ordinary knowledge in the technical field to which the present disclosure belongs can easily modify the embodiments into other specific forms without changing the technical idea or essential features of the present disclosure. Therefore, the embodiments described above should be understood in all respects as illustrative and not restrictive. For example, each component described as unitary may be implemented in a distributed manner, and similarly, components described as distributed may also be implemented in a combined form.

It should be interpreted that the scope of the present disclosure is indicated by the claims described later rather than the detailed description above, and the meaning and scope of the claims and all changes or modified forms derived from the equivalent concept are included in the scope of the present disclosure.

The present disclosure can be applied to a concrete block structure which is installed underwater or on the surface of the water for various purposes, such as a concrete structure installed underwater such as a berthing facility for a harbor, a wave-dissipating structure installed on the coast, and a breakwater, or a concrete structure floating on the surface of the water such as a platform for a wind power generation.

The invention claimed is:

1. A method for constructing a concrete block structure, the method comprising:

a first concrete block module installation step of installing a first concrete block module in which a first concrete block, a guide pole, and a tubular waterproof membrane are temporarily assembled with each other, wherein the first concrete block comprises a first concrete block body and a column rebar assembly extending vertically upward from the first concrete block body and protruding upward from the first concrete block body, wherein the guide pole comprises a guide pipe extending vertically, wherein the tubular waterproof membrane has a shape of a tube with open upper and lower parts, extends vertically along an inside of the guide pipe, and has a lower end arranged by being bent to an outside of the guide pipe, wherein the column rebar assembly extends vertically upward along an inside of the tubular waterproof membrane, and wherein the guide pipe is temporarily fixed on an upper surface of the first concrete block body;

a second concrete block installation step of installing a second concrete block comprising a second concrete block body having a through hole extending vertically such that a concrete block assembly is formed by installing the second concrete block on the first concrete block, wherein the guide pole is inserted into the through hole of the second concrete block after the first concrete block module installation step, wherein the concrete block assembly has a concrete-column continuous hole comprising the through hole and having a closed lower end; and a concrete column formation step of forming a concrete column, comprising pouring concrete into the tubular waterproof membrane and removing the guide pole to form the concrete column in which the column rebar assembly and the poured concrete are integrated with each other while extending vertically along the inside of the tubular waterproof membrane in the concrete-column continuous hole after the second concrete block installation step, wherein the first concrete block and the second concrete block are coupled to each other by the concrete column to form a concrete block structure.

2. The method of claim 1, wherein a watertight packing is provided on a lower end of the guide pipe so that water is prevented from being introduced into the guide pole from the outside.

3. The method of claim 1, wherein the column rebar assembly has a length to pass through the concrete-column continuous hole and protrude upward from the concrete-column continuous hole, and wherein the method further comprises a cap concrete formation step of forming a cap concrete on the concrete block assembly after the concrete column formation step such that an upper part of the column rebar assembly is embedded within the cap concrete.

* * * * *